US011401851B1

(12) United States Patent
Anshu

(10) Patent No.: US 11,401,851 B1
(45) Date of Patent: Aug. 2, 2022

(54) VEHICULAR EXHAUST SYSTEM

(71) Applicant: Tilahun Anshu, Lowell, MA (US)

(72) Inventor: Tilahun Anshu, Lowell, MA (US)

( * ) Notice: Subject to any disclaimer, the term of this patent is extended or adjusted under 35 U.S.C. 154(b) by 601 days.

(21) Appl. No.: 16/444,259

(22) Filed: Jun. 18, 2019

(51) Int. Cl.
*F01N 3/08* (2006.01)
*F01N 3/10* (2006.01)
*F01N 13/10* (2010.01)

(52) U.S. Cl.
CPC ..... *F01N 3/0814* (2013.01); *F01N 3/101* (2013.01); *F01N 3/105* (2013.01); *F01N 13/107* (2013.01)

(58) Field of Classification Search
CPC .. F01N 13/011; F01N 13/107; F01N 13/1805; F01N 2340/02; F01N 3/0814; F01N 3/101; F01N 3/105
See application file for complete search history.

(56) References Cited

U.S. PATENT DOCUMENTS 4,926,635 A * 5/1990 Sakuma ..... F01N 13/009 60/299
5,014,817 A * 5/1991 Takato ..... F01N 13/04 181/254
5,388,408 A * 2/1995 Lawrence ..... F01N 13/02 181/239
6,209,318 B1 * 4/2001 Rutschmann ..... F02B 27/06 60/322
6,435,272 B1 * 8/2002 Voss ..... F01N 13/107 15/4
7,703,574 B2 * 4/2010 Kruger ..... F01N 13/011 181/254
7,918,311 B2 * 4/2011 Matsueda ..... F01N 1/083 181/251
7,942,235 B2 * 5/2011 Mirlach ..... F01N 13/011 181/227
9,212,593 B2 * 12/2015 An ..... F01N 13/04
10,753,264 B2 * 8/2020 Klemenc ..... F01N 13/107
2002/0033302 A1 * 3/2002 Kaneko ..... F01N 1/165 181/275
2005/0155816 A1 * 7/2005 Alcini ..... F01N 13/011 181/236
2008/0093162 A1 * 4/2008 Marocco ..... F01N 1/02 181/250
2017/0298802 A1 * 10/2017 Hwang ..... F01N 13/107

FOREIGN PATENT DOCUMENTS

JP 2005054736 A * 3/2005

* cited by examiner

*Primary Examiner* — Jeremy A Luks
(74) *Attorney, Agent, or Firm* — Kyle A. Fletcher, Esq.

(57) ABSTRACT

The vehicular exhaust system presents a plurality of flow paths that transport exhaust gases between one or more catalytic converters and a muffler. The span of the length of each of the plurality of flow paths varies such that phase differences in the sound waves carried by the exhaust gas are generated. These phase differences cause the sound waves to cancel thereby reducing combustion engine sounds before the exhaust enters the muffler. The vehicular exhaust system comprises a plurality of pipes, a plurality of connectors, and a plurality of cants. The plurality of connectors form fluidic connections between the plurality of pipes to form a manifold that creates the plurality of flow paths. The plurality of cants are angles formed within the manifold structure that change the span of length of each of the plurality of flow paths.

16 Claims, 2 Drawing Sheets

VEHICULAR EXHAUST SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of mechanical engineering including gas flow silencers, more specifically, an exhaust silencer. (F01N13/007)

SUMMARY OF INVENTION

The vehicular exhaust system is configured for use with a vehicle. The vehicle comprises one or more catalytic converters, a muffler, and a combustion engine. The vehicular exhaust system transports exhaust gases discharged by the combustion engine and from the one or more catalytic converters to the muffler. The vehicular exhaust system presents a plurality of flow paths to the discharged exhaust gases. The span of the length of each of the plurality of flow paths varies such that phase differences in the sound waves carried by the exhaust gas that are generated by each of the plurality of flow paths are introduced into the exhaust gas flow when the plurality of flow paths are recombined at the muffler. These phase differences cause the sound waves to cancel thereby reducing combustion engine sounds before the exhaust enters the muffler. The vehicular exhaust system comprises a plurality of pipes, a plurality of connectors, and a plurality of cants. The plurality of connectors form fluidic connections between the plurality of pipes to form a manifold that creates the plurality of flow paths. The plurality of cants are angles formed within the manifold structure that change the span of the length of each of the plurality of flow paths.

These together with additional objects, features and advantages of the vehicular exhaust system will be readily apparent to those of ordinary skill in the art upon reading the following detailed description of the presently preferred, but nonetheless illustrative, embodiments when taken in conjunction with the accompanying drawings.

In this respect, before explaining the current embodiments of the vehicular exhaust system in detail, it is to be understood that the vehicular exhaust system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the vehicular exhaust system.

It is therefore important that the claims be regarded as including such equivalent construction insofar as they do not depart from the spirit and scope of the vehicular exhaust system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
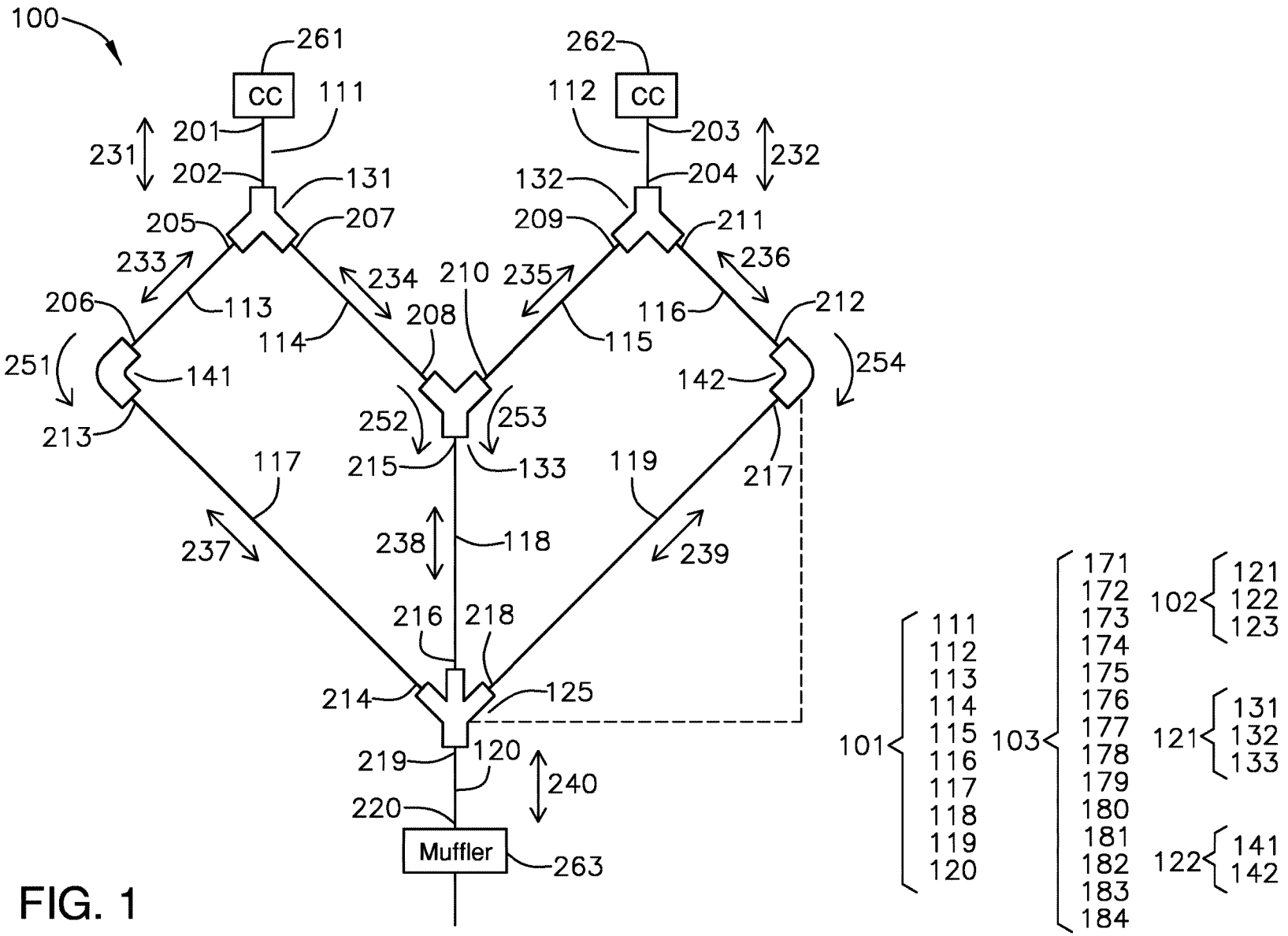
FIG. 1 is a top view of an embodiment of the disclosure.
Figure 2:
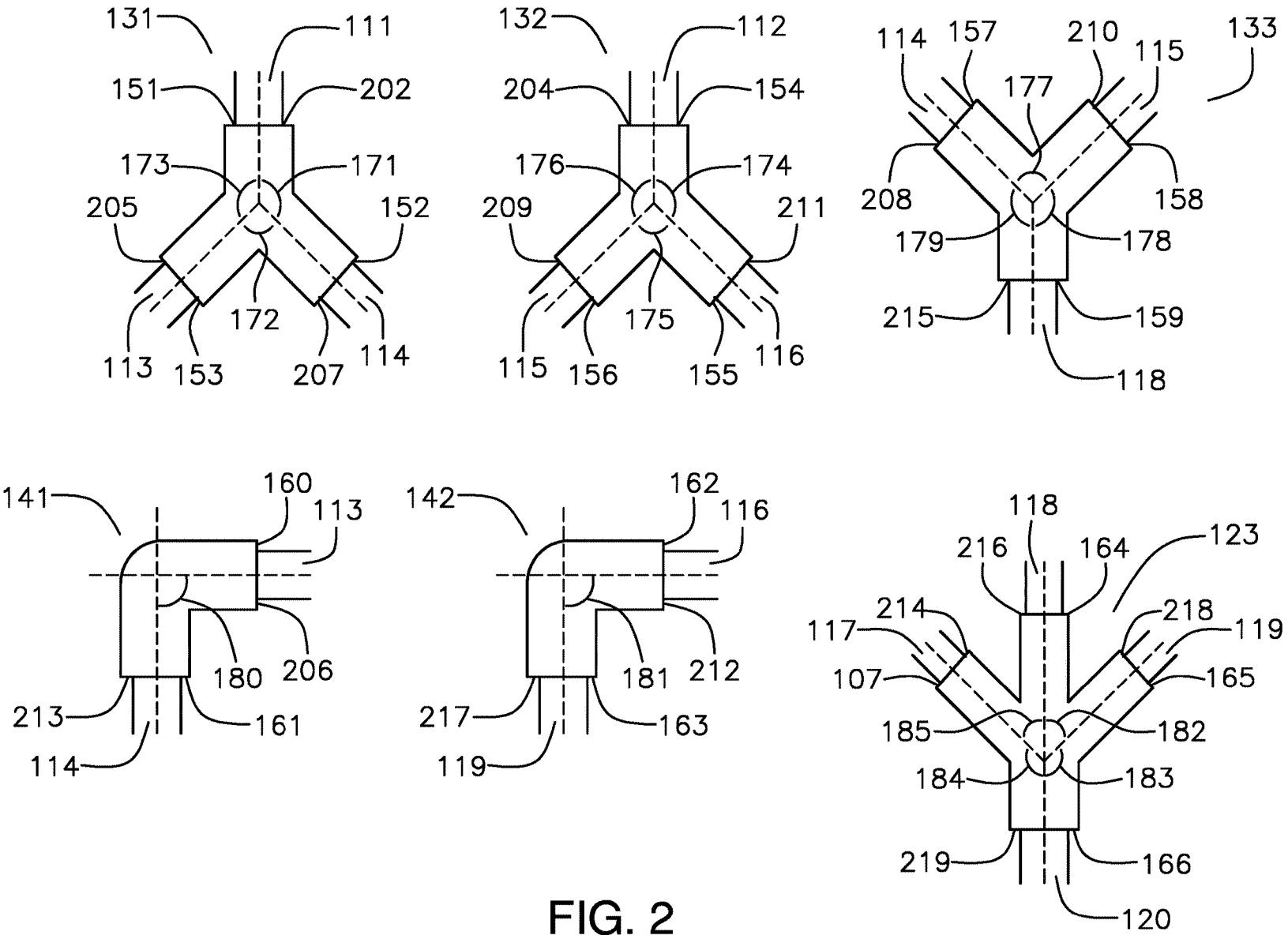
FIG. 2 is a detail view of an embodiment of the disclosure.

Detailed reference will now be made to one or more potential embodiments of the disclosure, which are illustrated in FIGS. 1 through 2.

The vehicular exhaust system 100 (hereinafter invention) is configured for use with a vehicle. The vehicle comprises one or more catalytic converters, a muffler 263, and a combustion engine. The invention 100 transports exhaust gases discharged by the one or more catalytic converters to the muffler 263. The invention 100 presents a plurality of flow paths to the discharged exhaust gases. The span of the length of each of the plurality of flow paths varies such that phase differences in the sound waves carried by the exhaust gas that are generated by each of the plurality of flow paths are introduced into the exhaust gas flow when the plurality of flow paths are recombined at the muffler 263. These phase differences cause the sound waves to cancel thereby reducing combustion engine sounds before the exhaust enters the muffler 263.

The invention 100 comprises a plurality of pipes 101, a plurality of connectors 102, and a plurality of cants 103. The plurality of connectors 102 form fluidic connections between the plurality of pipes 101 to form a manifold that creates the plurality of flow paths. The plurality of cants 103 are angles formed within the manifold structure that change the span of the length of each of the plurality of flow paths.

The one or more catalytic converters comprises a first catalytic converter 261 and a second catalytic converter 262. The plurality of flow paths comprises a first flow path 251, a second flow path 252, a third flow path 253, and a fourth flow path 254.

Each of the plurality of cants 103 is a cant that is formed between the center axes of two pipes selected from the plurality of pipes 101 that are fluidically connected using a connector selected from the plurality of connectors 102. Each of the plurality of cants 103 are used to control the span of the length of a flow path selected from the group consisting of the first flow path 251, the second flow path 252, the third flow path 253, and the fourth flow path 254. The plurality of cants 103 comprises a first cant 171, a second cant 172, a third cant 173, a fourth cant 174, a fifth cant 175, a sixth cant 176, a seventh cant 177, an eighth cant 178, a ninth cant 179, a tenth cant 180, an eleventh cant 181, a twelfth cant 182, a thirteenth cant 183, a fourteenth cant 184, and a fifteenth cant 185.

Each of the plurality of pipes 101 is a commercially available pipe that is used to transport exhaust gas through the invention 100. The plurality of pipes 101 comprises a first pipe 111, a second pipe 112, a third pipe 113, a fourth pipe 114, a fifth pipe 115, a sixth pipe 116, a seventh pipe 117, an eighth pipe 118, a ninth pipe 119, and a tenth pipe 120.

The first pipe 111 is a pipe selected from the plurality of pipes 101. The second pipe 112 is a pipe selected from the plurality of pipes 101. The third pipe 113 is a pipe selected from the plurality of pipes 101. The fourth pipe 114 is a pipe selected from the plurality of pipes 101. The fifth pipe 115 is a pipe selected from the plurality of pipes 101.

The sixth pipe 116 is a pipe selected from the plurality of pipes 101. The seventh pipe 117 is a pipe selected from the plurality of pipes 101. The eighth pipe 118 is a pipe selected from the plurality of pipes 101. The ninth pipe 119 is a pipe selected from the plurality of pipes 101. The tenth pipe 120 is a pipe selected from the plurality of pipes 101.

The first pipe 111 forms a fluidic connection that transports gas between the first catalytic converter 261 and the first Y connector 131. The second pipe 112 forms a fluidic connection that transports gas between the second catalytic converter 262 and the second Y connector 132. The first pipe 111 is further defined with a first end 201, a second end 202, and a first span of length 231. The second pipe 112 is further defined with a third end 203, a fourth end 204, and a second span of length 232.

The first span of length 231 is the span of the length of the first pipe 111. The reach of the first span of length 231 is determined by the design of the vehicle. The second span of length 232 is the span of the length of the second pipe 112. The reach of the second span of length 232 is determined by the design of the vehicle.

The third pipe 113 forms a fluidic connection that transports gas between the first Y connector 131 and the first elbow connector 141. The fourth pipe 114 forms a fluidic connection that transports gas between the first Y connector 131 and the third Y connector 133. The fifth pipe 115 forms a fluidic connection that transports gas between the second Y connector 132 and the third Y connector 133. The sixth pipe 116 forms a fluidic connection that transports gas between the second Y connector 132 and the second elbow connector 142.

The third pipe 113 is further defined with a fifth end 205, a sixth end 206, and a third span of length 233. The fourth pipe 114 is further defined with a seventh end 207, an eighth end 208, and a fourth span of length 234. The fifth pipe 115 is further defined with a ninth end 209, a tenth end 210, and a fifth span of length 235. The sixth pipe 116 is further defined with an eleventh end 211, a twelfth end 212, and a sixth span of length 236.

The third span of length 233 is the span of the length of the third pipe 113 The third span of length 233 of the third pipe 113 is the key measurement of the invention 100. The third span of length 233 of the third pipe 113 determines the differences in the spans of the lengths of the: a) first flow path 251 and the second flow path 252; b) the first flow path 251 and the third flow path 253; c) the fourth flow path 254 and the second flow path 252; and, d) the fourth flow path 254 and the third flow path 253 that create the phase differences that allow the engine noises to cancel out within the invention 100.

The fourth span of length 234 is the span of the length of the fourth pipe 114. The reach of the fourth span of length 234 roughly equals the third span of length 233 of the third pipe 113. The fifth span of length 235 is the span of the length of the fifth pipe 115. The reach of the fifth span of length 235 roughly equals the third span of length 233 of the third pipe 113. The sixth span of length 236 is the span of the length of the sixth pipe 116. The reach of the sixth span of length 236 roughly equals the third span of length 233 of the third pipe 113.

While the optimum value for the third span of length 233 of the third pipe 113 will vary based on the operating environment and the design of the vehicle, the applicant recommends that a good working value (in meters) for the third span of length 233 of the third pipe 113 roughly equals: 4.8 times the number of cylinders in the vehicle divided by the idle RPM of the vehicle.

The seventh pipe 117 forms a fluidic connection that transports gas between the first elbow connector 141 and the quad connector 123. The eighth pipe 118 forms a fluidic connection that transports gas between the third Y connector 133 and the quad connector 123. The ninth pipe 119 forms a fluidic connection that transports gas between the second elbow connector 142 and the quad connector 123. The tenth pipe 120 forms a fluidic connection that transports gas between the quad connector 123 and the muffler 263.

The seventh pipe 117 is further defined with a thirteenth end 213, a fourteenth end 214, and a seventh span of length 237. The eighth pipe 118 is further defined with a fifteenth end 215, a sixteenth end 216, and an eighth span of length 238. The ninth pipe 119 is further defined with a seventeenth end 217, an eighteenth end 218, and a ninth span of length 239. The tenth pipe 120 is further defined with a nineteenth end 219, a twentieth end 220, and a tenth span of length 240.

The seventh span of length 237 is the span of the length of the seventh pipe 117. The reach of the seventh span of length 237 roughly equals two times the third span of length 233 of the third pipe 113. The eighth span of length 238 is the span of the length of the eighth pipe 118. The reach of the eighth span of length 238 roughly equals the square root of two times the third span of length 233 of the third pipe 113. The ninth span of length 239 is the span of the length of the ninth pipe 119. The reach of the ninth span of length 239 roughly equals two times the third span of length 233 of the third pipe 113. The tenth span of length 240 is the span of the length of the tenth pipe 120. The reach of the tenth span of length 240 is determined by the design of the vehicle.

Each of the plurality of connectors 102 is a fitting. Each of the plurality of connectors 102 forms a fluidic connection between two or more pipes selected from the plurality of pipes 101. The plurality of connectors 102 comprises a plurality of Y connectors 121, a plurality of elbow connectors 122, and a quad connector 123.

Each of the plurality of Y connectors 121 is a three-port connector that forms a fluidic connection between three pipes selected from the plurality of pipes 101. When a gas enters a Y connector selected from the plurality of Y connectors 121 through a single port, the selected Y connector evenly divides the flow of the gas between the other two ports. When a gas enters a Y connector selected from the plurality of Y connectors 121 through two ports, the selected Y connector evenly merges the flow of the two gas streams into the third port. The plurality of Y connectors 121 comprises a first Y connector 131, a second Y connector 132, and a third Y connector 133.

The first Y connector 131 splits the gas flow from the first catalytic converter 261 into the first flow path 251 and the second flow path 252. The first Y connector 131 forms a fluidic connection that transports gas between the first pipe 111 and the third pipe 113. The first Y connector 131 forms a fluidic connection that transports gas between the first pipe 111 and the fourth pipe 114. The first Y connector 131 further comprises a first port 151, a second port 152, and the third port 153. The first Y connector 131 forms the first cant 171, the second cant 172, and the third cant 173.

The first cant 171 is the span of the arc between the center axis of the first port 151 of the first Y connector 131 and the center axis of the second port 152 of the first Y connector 131. In the first potential embodiment of the disclosure, the first cant 171 roughly equals 135 degrees. The second cant 172 is the span of the arc between the center axis of the second port 152 of the first Y connector 131 and the center axis of the third port 153 of the first Y connector 131. In the first potential embodiment of the disclosure, the second cant 172 roughly equals 90 degrees. The third cant 173 is the span of the arc between the center axis of the third port 153 of the first Y connector 131 and the center axis of the first port 151 of the first Y connector 131. In the first potential embodiment of the disclosure, the third cant 173 roughly equals 135 degrees.

The second Y connector 132 splits the gas flow from the second catalytic converter 262 into the third flow path 253 and the fourth flow path 254. The second Y connector 132 forms a fluidic connection that transports gas between the second pipe 112 and the fifth pipe 115. The second Y connector 132 forms a fluidic connection that transports gas between the second pipe 112 and the sixth pipe 116. The second Y connector 132 further comprises a fourth port 154, a fifth port 155, and the sixth port 156. The second Y connector 132 forms the fourth cant 174, the fifth cant 175, and the sixth cant 176.

The fourth cant 174 is the span of the arc between the center axis of the fourth port 154 of the second Y connector 132 and the center axis of the fifth port 155 of the second Y connector 132. In the first potential embodiment of the disclosure, the fourth cant 174 roughly equals 135 degrees. The fifth cant 175 is the span of the arc between the center axis of the fifth port 155 of the second Y connector 132 and the center axis of the sixth port 156 of the second Y connector 132. In the first potential embodiment of the disclosure, the fifth cant 175 roughly equals 90 degrees. The sixth cant 176 is the span of the arc between the center axis of the sixth port 156 of the second Y connector 132 and the center axis of the fourth port 154 of the second Y connector 132. In the first potential embodiment of the disclosure, the sixth cant 176 roughly equals 135 degrees.

The third Y connector 133 merges the gas flow of the second flow path 252 and the third flow path 253 into a single gas flow. The third Y connector 133 forms a fluidic connection that transports gas between the fourth pipe 114 and the eighth pipe 118. The third Y connector 133 forms a fluidic connection that transports gas between the fifth pipe 115 and the eighth pipe 118. The third Y connector 133 further comprises a seventh port 157, an eighth port 158, and the ninth port 159. The third Y connector 133 forms the seventh cant 177, the eighth cant 178, and the ninth cant 179.

The seventh cant 177 is the span of the arc between the center axis of the seventh port 157 of the third Y connector 133 and the center axis of the eighth port 158 of the third Y connector 133. In the first potential embodiment of the disclosure, the seventh cant 177 roughly equals 90 degrees. The eighth cant 178 is the span of the arc between the center axis of the eighth port 158 of the third Y connector 133 and the center axis of the ninth port 159 of the third Y connector 133. In the first potential embodiment of the disclosure, the eighth cant 178 roughly equals 135 degrees. The ninth cant 179 is the span of the arc between the center axis of the ninth port 159 of the third Y connector 133 and the center axis of the seventh port 157 of the third Y connector 133. In the first potential embodiment of the disclosure, the ninth cant 179 roughly equals 135 degrees.

Each of the plurality of elbow connectors 122 is a 90 degree elbow. The 90 degree elbow is defined elsewhere in this disclosure. The plurality of elbow connectors 122 comprises a first elbow connector 141 and a second elbow connector 142.

The first elbow connector 141 forms a fluidic connection that transports gas between the third pipe 113 and the seventh pipe 117. The first elbow connector 141 further comprises a tenth port 160 and an eleventh port 161. The first elbow connector 141 forms the tenth cant 180. The tenth cant 180 is the span of the arc between the center axis of the tenth port 160 of the first elbow connector 141 and the center axis of the eleventh port 161 of the first elbow connector 141. In the first potential embodiment of the disclosure, the tenth cant 180 roughly equals 90 degrees.

The second elbow connector 142 forms a fluidic connection that transports gas between the sixth pipe 116 and the ninth pipe 119. The second elbow connector 142 further comprises a twelfth port 162 and a thirteenth port 163. The second elbow connector 142 forms the eleventh cant 181. The eleventh cant 181 is the span of the arc between the center axis of the twelfth port 162 of the second elbow connector 142 and the center axis of the thirteenth port 163 of the second elbow connector 142. In the first potential embodiment of the disclosure, the eleventh cant 181 roughly equals 90 degrees.

The quad connector 123 is a four-port connector. The quad connector 123 merges the gas flowing through the first flow path 251, the second flow path 252, the third flow path 253, and the fourth flow path 254 into a single gas flow that is transported to the muffler 263. The quad connector 123 forms a fluidic connection that transports gas between the seventh pipe 117 and the tenth pipe 120. The quad connector 123 forms a fluidic connection that transports gas between the eighth pipe 118 and the tenth pipe 120. The quad connector 123 forms a fluidic connection that transports gas between the ninth pipe 119 and the tenth pipe 120. The quad connector 123 further comprises a fourteenth port 164, a fifteenth port 165, a sixteenth port 166, and a seventeenth port 167. The quad connector 123 forms the twelfth cant 182, the thirteenth cant 183, the fourteenth cant 184, and the fifteenth cant 185.

The twelfth cant 182 is the span of the arc between the center axis of the fourteenth port 164 of the quad connector 123 and the center axis of the fifteenth port 165 of the quad connector 123. In the first potential embodiment of the disclosure, the twelfth cant 182 roughly equals 45 degrees. The thirteenth cant 183 is the span of the arc between the center axis of the fifteenth port 165 of the quad connector 123 and the center axis of the sixteenth port 166 of the quad connector 123. In the first potential embodiment of the disclosure, the thirteenth cant 183 roughly equals 135 degrees.

The fourteenth cant 184 is the span of the arc between the center axis of the sixteenth port 166 of the quad connector 123 and the center axis of the seventeenth port 167 of the quad connector 123. In the first potential embodiment of the disclosure, the fourteenth cant 184 roughly equals 135 degrees. The fifteenth cant 185 is the span of the arc between the center axis of the seventeenth port 167 of the quad connector 123 and the center axis of the sixteenth port 166 of the quad connector 123. In the first potential embodiment of the disclosure, the fifteenth cant 185 roughly equals 45 degrees.

The first flow path 251 is formed using the third pipe 113, the first elbow connector 141, the seventh pipe 117, and the quad connector 123. The second flow path 252 is formed using the fourth pipe 114, the third Y connector 133, the eighth pipe 118, and the quad connector 123. The third flow path 253 is formed using the fifth pipe 115, the third Y connector 133, the eighth pipe 118, and the quad connector 123. The fourth flow path 254 is formed using the sixth pipe 116, the second elbow connector 142, the ninth pipe 119, and the quad connector 123.

The following five paragraphs describe the assembly of the invention 100.

The first end 201 of the first pipe 111 forms a fluidic connection to the first catalytic converter 261. The second end 202 of the first pipe 111 forms a fluidic connection to the first port 151 of the first Y connector 131. The third end 203 of the second pipe 112 forms a fluidic connection to the second catalytic converter 262. The fourth end 204 of the second pipe 112 forms a fluidic connection to the fourth port 154 of the second Y connector 132.

The fifth end 205 of the third pipe 113 forms a fluidic connection to the third port 153 of the first Y connector 131. The sixth end 206 of the third pipe 113 forms a fluidic connection to the tenth port 160 of the first elbow connector 141. The seventh end 207 of the fourth pipe 114 forms a fluidic connection to the second port 152 of the first Y connector 131. The eighth end 208 of the fourth pipe 114 forms a fluidic connection to the seventh port 157 of the third Y connector 133.

The ninth end 209 of the fifth pipe 115 forms a fluidic connection to the sixth port 156 of the second Y connector 132. The tenth end 210 of the fifth pipe 115 forms a fluidic connection to the eighth port 158 of the third Y connector 133. The eleventh end 211 of the sixth pipe 116 forms a fluidic connection to the fifth port 155 of the second Y connector 132. The twelfth end 212 of the sixth pipe 116 forms a fluidic connection to the twelfth port 162 of the second elbow connector 142.

The thirteenth end 213 of the seventh pipe 117 forms a fluidic connection to the eleventh port 161 of the first elbow connector 141. The fourteenth end 214 of the seventh pipe 117 forms a fluidic connection to the seventeenth port 167 of the quad connector 123. The fifteenth end 215 of the eighth pipe 118 forms a fluidic connection to the ninth port 159 of the third Y connector 133. The sixteenth end 216 of the eighth pipe 118 forms a fluidic connection to the fourteenth port 164 of the quad connector 123.

The seventeenth end 217 of the ninth pipe 119 forms a fluidic connection to the thirteenth port 163 of the second elbow connector 142. The eighteenth end 218 of the ninth pipe 119 forms a fluidic connection to the fifteenth port 165 of the quad connector 123. The nineteenth end 219 of the tenth pipe 120 forms a fluidic connection to the sixteenth port 166 of the quad connector 123. The twentieth end 220 of the tenth pipe 120 forms a fluidic connection to the muffler 263.

The following definitions were used in this disclosure:

90 Degree Elbow: As used in this disclosure, a 90 degree elbow is a two-aperture fitting that attaches a first pipe to a second pipe such that the center axis of the first pipe is perpendicular to the center axis of the second pipe.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle, the arc also refers to a measure of an angular span as measured from a circle at the vertex formed by the sides of the angle.

Cant: As used in this disclosure, a cant is an angular deviation from one or more reference lines (or planes) such as a vertical line (or plane) or a horizontal line (or plane).

Catalytic Converter: As used in this disclosure, a catalytic converter is a component is a vehicle exhaust system that chemically converts: a) carbon monoxide into carbon dioxide, b) nitrogen oxide into nitrogen and oxygen, and, c) unconsumed hydrocarbons into carbon dioxide and water.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Combustion engine: As used in this disclosure, a combustion engine is an engine powered by burning fuel within the engine. Two common examples would be: 1) internal combustion engines; and, 2) engines designed with one or more cylinders where combustion takes place within the cylinder.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Connector: As used in this disclosure, a connector is a manifold used to form a fluidic connection between two or more pipes.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Engine: As used in this disclosure, an engine is a device with moving parts that is used to convert energy into rotational or linear motion.

Fitting: As used in this disclosure, a fitting is a component that is attached to a first object. The fitting is used to forming a fluidic connection between the first object and a second object.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Frequency: As used in this disclosure, frequency is a count of the number of repetitions of a cyclic process that are completed within a previously determined duration.

Frequency and Wavelength: As used in this disclosure, the terms frequency and wavelength refer to parameters used to describe a wave that transmits or transfers energy. The frequency measures the frequency of passage of a fixed point of the waveform of the wave. The wavelength describes the span of distance between the fixed points of the waveform of two sequential waves. The wavelength and frequency are related by the equation: wavelength× frequency=wave speed through the media. For many types of waves (such as sound and light), the speed of the wave through the media can be taken as a constant.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Inner Dimension: As used in this disclosure, the term inner dimension describes the span from a first inside or interior surface of a container to a second inside or interior surface of a container. The term is used in much the same way that a plumber would refer to the inner diameter of a pipe.

Liquid: As used in this disclosure, a liquid refers to a state (phase) of matter that is fluid and that maintains, for a given pressure, a fixed volume that is independent of the volume of the container.

Manifold: As used in this disclosure, a manifold is a pipe or chamber having several ports through which liquid or gas is gathered or distributed.

Muffler: As used in this disclosure, a muffler is a mechanical structure used to reduce the audible sounds generated by a combustion engine.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different. See negligible difference.

Offset: As used in this disclosure, an offset refers to the span of distance or cant by which two objects are out of alignment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Phase: As used in this disclosure, the term phase, or phase difference, refers to an offset between two identical waveforms that are transferring energy. The offset, which can roughly be thought of as a delay, between the two identical waveforms is measured as an angular difference. The offset measured by the phase allows identical waveforms to cancel each other out.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Port: As used in this disclosure, a port is an opening formed in an object that allows fluid to flow through the boundary of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Reach: As used in this disclosure, reach refers to a span of distance between any two objects.

Roughly: As used in this disclosure, roughly refers to a comparison between two objects. Roughly means that the difference between one or more parameters of the two compared are not significantly different.

Vehicle: As used in this disclosure, a vehicle is a motorized device used for transporting passengers, goods, or equipment. The term motorized vehicle refers to a vehicle can move under power provided by an electric motor or an internal combustion engine.

With respect to the above description, it is to be realized that the optimum dimensional relationship for the various components of the invention described above and in FIGS. 1 through 2 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A gas flow silencer comprising a plurality of pipes, a plurality of connectors, and a plurality of cants;

wherein the plurality of connectors form fluidic connections between the plurality of pipes to form a manifold that creates a plurality of flow paths;

wherein the plurality of cants are angles formed within the manifold structure;

wherein the gas flow silencer is configured for use with a one or more catalytic converters, a muffler, and a combustion engine;

wherein the gas flow silencer transports exhaust gases discharged by the one or more catalytic converters to the muffler;

wherein the one or more catalytic converters comprises a first catalytic converter and a second catalytic converter;

wherein the plurality of flow paths comprises a first flow path, a second flow path, a third flow path, and a fourth flow path;

wherein the span of the length of each of the plurality of flow paths varies such that phase differences in sound waves are introduced into the exhaust gas flow when the plurality of flow paths are recombined;

wherein each of the plurality of cants is a cant that is formed between the center axes of two pipes selected from the plurality of pipes that are fluidically connected using a connector selected from the plurality of connectors;

wherein each of the plurality of cants are used to control the span of the length of a flow path selected from the group consisting of the first flow path, the second flow path, the third flow path, and the fourth flow path;

wherein the plurality of cants comprises a first cant, a second cant, a third cant, a fourth cant, a fifth cant, a sixth cant, a seventh cant, an eighth cant, a ninth cant, a tenth cant, an eleventh cant, a twelfth cant, a thirteenth cant, a fourteenth cant, and a fifteenth cant;

wherein each of the plurality of connectors is a fitting;

wherein each of the plurality of connectors forms a fluidic connection between two or more pipes selected from the plurality of pipes;

wherein each of the plurality of pipes is a pipe that transports exhaust gas through the gas flow silencer;

wherein the plurality of pipes comprises a first pipe, a second pipe, a third pipe, a fourth pipe, a fifth pipe, a sixth pipe, a seventh pipe, an eighth pipe, a ninth pipe, and a tenth pipe;

wherein the first pipe is a pipe;

wherein the second pipe is a pipe;

wherein the third pipe is a pipe;

wherein the fourth pipe is a pipe;

wherein the fifth pipe is a pipe;

wherein the sixth pipe is a pipe;

wherein the seventh pipe is a pipe;

wherein the eighth pipe is a pipe;

wherein the ninth pipe is a pipe;

wherein the tenth pipe is a pipe;

wherein the first pipe is further defined with a first end, a second end, and a first span of length;

wherein the second pipe is further defined with a third end, a fourth end, and a second span of length;

wherein the third pipe is further defined with a fifth end, a sixth end, and a third span of length;

wherein the fourth pipe is further defined with a seventh end, an eighth end, and a fourth span of length;

wherein the seventh pipe is further defined with a thirteenth end, a fourteenth end, and a seventh span of length;

wherein the eighth pipe is further defined with a fifteenth end, a sixteenth end, and an eighth span of length;

wherein the ninth pipe is further defined with a seventeenth end, an eighteenth end, and a ninth span of length;

wherein the tenth pipe is further defined with a nineteenth end, a twentieth end, and a tenth span of length;

wherein the first span of length is the span of the length of the first pipe;

wherein the second span of length is the span of the length of the second pipe;

wherein the third span of length is the span of the length of the third;

wherein the fourth span of length is the span of the length of the fourth pipe;

wherein the reach of the fourth span of length roughly equals the third span of length of the third pipe;

wherein the fifth span of length is the span of the length of the fifth pipe;

wherein the reach of the fifth span of length roughly equals the third span of length of the third pipe;

wherein the sixth span of length is the span of the length of the sixth pipe;

wherein the reach of the sixth span of length roughly equals the third span of length of the third pipe;

wherein the seventh span of length is the span of the length of the seventh pipe;

wherein the reach of the seventh span of length roughly equals two times the third span of length of the third pipe;

wherein the eighth span of length is the span of the length of the eighth pipe;

wherein the reach of the eighth span of length roughly equals the square root of two times the third span of length of the third pipe;

wherein the ninth span of length is the span of the length of the ninth pipe;

wherein the reach of the ninth span of length roughly equals two times the third span of length of the third pipe;

wherein the tenth span of length is the span of the length of the tenth pipe.

2. The gas flow silencer according to claim 1 wherein the plurality of connectors comprises a plurality of Y connectors, a plurality of elbow connectors, and a quad connector;

wherein each of the plurality of Y connectors is a three-port connector that forms a fluidic connection between three pipes selected from the plurality of pipes;

wherein each of the plurality of elbow connectors is a 90 degree elbow;

wherein the quad connector is a four-port connector;

wherein the quad connector merges the gas flowing through the first flow path, the second flow path, the third flow path, and the fourth flow path into a single gas flow that is transported to the muffler.

3. The gas flow silencer according to claim 2 wherein when a gas enters a Y connector selected from the plurality of Y connectors through a single port, the selected Y connector evenly divides the flow of the gas between the other two ports;

wherein when a gas enters a Y connector selected from the plurality of Y connectors through two ports, the selected Y connector evenly merges the flow of the two gas streams into the third port.

4. The gas flow silencer according to claim 3 wherein the plurality of Y connectors comprises a first Y connector, a second Y connector, and a third Y connector;

wherein the first Y connector splits the gas flow from the first catalytic converter into the first flow path and the second flow path;

wherein the first Y connector forms a fluidic connection that transports gas between the first pipe and the third pipe;

wherein the first Y connector forms a fluidic connection that transports gas between the first pipe and the fourth pipe;

wherein the second Y connector splits the gas flow from the second catalytic converter into the third flow path and the fourth flow path;

wherein the second Y connector forms a fluidic connection that transports gas between the second pipe and the fifth pipe;

wherein the second Y connector forms a fluidic connection that transports gas between the second pipe and the sixth pipe;

wherein the third Y connector merges the gas flow of the second flow path and the third flow path into a single gas flow;

wherein the third Y connector forms a fluidic connection that transports gas between the fourth pipe and the eighth pipe;

wherein the third Y connector forms a fluidic connection that transports gas between the fifth pipe and the eighth pipe.

5. The gas flow silencer according to claim 4 wherein the first Y connector further comprises a first port, a second port, and the third port;

wherein the first Y connector forms the first cant, the second cant, and the third cant;

wherein the first cant is the span of the arc between the center axis of the first port of the first Y connector and the center axis of the second port of the first Y connector;

wherein the second cant is the span of the arc between the center axis of the second port of the first Y connector and the center axis of the third port of the first Y connector;

wherein the third cant is the span of the arc between the center axis of the third port of the first Y connector and the center axis of the first port of the first Y connector.

6. The gas flow silencer according to claim 5 wherein the second Y connector further comprises a fourth port, a fifth port, and the sixth port;

wherein the second Y connector forms the fourth cant, the fifth cant, and the sixth cant;

wherein the fourth cant is the span of the arc between the center axis of the fourth port of the second Y connector and the center axis of the fifth port of the second Y connector;

wherein the fifth cant is the span of the arc between the center axis of the fifth port of the second Y connector and the center axis of the sixth port of the second Y connector;

wherein the sixth cant is the span of the arc between the center axis of the sixth port of the second Y connector and the center axis of the fourth port of the second Y connector.

7. The gas flow silencer according to claim 6 wherein the third Y connector further comprises a seventh port, an eighth port, and the ninth port;

wherein the third Y connector forms the seventh cant, the eighth cant, and the ninth cant;

wherein the seventh cant is the span of the arc between the center axis of the seventh port of the third Y connector and the center axis of the eighth port of the third Y connector;

wherein the eighth cant is the span of the arc between the center axis of the eighth port of the third Y connector and the center axis of the ninth port of the third Y connector;

wherein the ninth cant is the span of the arc between the center axis of the ninth port of the third Y connector and the center axis of the seventh port of the third Y connector.

8. The gas flow silencer according to claim 6 wherein the first cant roughly equals 135 degrees;

wherein the second cant roughly equals 90 degrees;

wherein the third cant roughly equals 135 degrees;

wherein the fourth cant roughly equals 135 degrees;

wherein the fifth cant roughly equals 90 degrees;

wherein the sixth cant roughly equals 135 degrees;

wherein the seventh cant roughly equals 90 degrees;

wherein the eighth cant roughly equals 135 degrees;

wherein the ninth cant roughly equals 135 degrees.

9. The gas flow silencer according to claim 8
wherein the plurality of elbow connectors comprises a first elbow connector and a second elbow connector;
wherein the first elbow connector forms a fluidic connection that transports gas between the third pipe and the seventh pipe;
wherein the second elbow connector forms a fluidic connection that transports gas between the sixth pipe and the ninth pipe.

10. The gas flow silencer according to claim 9
wherein the first elbow connector further comprises a tenth port and an eleventh port;
wherein the first elbow connector forms the tenth cant;
wherein the tenth cant is the span of the arc between the center axis of the tenth port of the first elbow connector and the center axis of the eleventh port of the first elbow connector;
wherein the second elbow connector further comprises a twelfth port and a thirteenth port;
wherein the second elbow connector forms the eleventh cant;
wherein the eleventh cant is the span of the arc between the center axis of the twelfth port of the second elbow connector and the center axis of the thirteenth port of the second elbow connector.

11. The gas flow silencer according to claim 10
wherein the tenth cant roughly equals 90 degrees;
wherein the eleventh cant roughly equals 90 degrees.

12. The gas flow silencer according to claim 11
wherein the quad connector forms a fluidic connection that transports gas between the seventh pipe and the tenth pipe;
wherein the quad connector forms a fluidic connection that transports gas between the eighth pipe and the tenth pipe;
wherein the quad connector forms a fluidic connection that transports gas between the ninth pipe and the tenth pipe.

13. The gas flow silencer according to claim 12
wherein the quad connector further comprises a fourteenth port, a fifteenth port, a sixteenth port, and a seventeenth port;
wherein the quad connector forms the twelfth cant, the thirteenth cant, the fourteenth cant, and the fifteenth cant;
wherein the twelfth cant is the span of the arc between the center axis of the fourteenth port of the quad connector and the center axis of the fifteenth port of the quad connector;
wherein the thirteenth cant is the span of the arc between the center axis of the fifteenth port of the quad connector and the center axis of the sixteenth port of the quad connector;
wherein the fourteenth cant is the span of the arc between the center axis of the sixteenth port of the quad connector and the center axis of the seventeenth port of the quad connector;
wherein the fifteenth cant is the span of the arc between the center axis of the seventeenth port of the quad connector and the center axis of the sixteenth port of the quad connector.

14. The gas flow silencer according to claim 13
wherein the twelfth cant roughly equals 45 degrees;
wherein the thirteenth cant roughly equals 135 degrees;
wherein the fourteenth cant roughly equals 135 degrees;
wherein the fifteenth cant roughly equals 45 degrees.

15. The gas flow silencer according to claim 14
wherein the first flow path is formed using the third pipe, the first elbow connector, the seventh pipe, and the quad connector;
wherein the second flow path is formed using the fourth pipe, the third Y connector, the eighth pipe, and the quad connector;
wherein the third flow path is formed using the fifth pipe, the third Y connector, the eighth pipe, and the quad connector;
wherein the fourth flow path is formed using the sixth pipe, the second elbow connector, the ninth pipe, and the quad connector.

16. The gas flow silencer according to claim 15
wherein the first end of the first pipe forms a fluidic connection to the first catalytic converter;
wherein the second end of the first pipe forms a fluidic connection to the first port of the first Y connector;
wherein the third end of the second pipe forms a fluidic connection to the second catalytic converter;
wherein the fourth end of the second pipe forms a fluidic connection to the fourth port of the second Y connector;
wherein the fifth end of the third pipe forms a fluidic connection to the third port of the first Y connector;
wherein the sixth end of the third pipe forms a fluidic connection to the tenth port of the first elbow connector;
wherein the seventh end of the fourth pipe forms a fluidic connection to the second port of the first Y connector;
wherein the eighth end of the fourth pipe forms a fluidic connection to the seventh port of the third Y connector;
wherein the ninth end of the fifth pipe forms a fluidic connection to the sixth port of the second Y connector;
wherein the tenth end of the fifth pipe forms a fluidic connection to the eighth port of the third Y connector;
wherein the eleventh end of the sixth pipe forms a fluidic connection to the fifth port of the second Y connector;
wherein the twelfth end of the sixth pipe forms a fluidic connection to the twelfth port of the second elbow connector;
wherein the thirteenth end of the seventh pipe forms a fluidic connection to the eleventh port of the first elbow connector;
wherein the fourteenth end of the seventh pipe forms a fluidic connection to the seventeenth port of the quad connector;
wherein the fifteenth end of the eighth pipe forms a fluidic connection to the ninth port of the third Y connector;
wherein the sixteenth end of the eighth pipe forms a fluidic connection to the fourteenth port of the quad connector;
wherein the seventeenth end of the ninth pipe forms a fluidic connection to the thirteenth port of the second elbow connector;
wherein the eighteenth end of the ninth pipe forms a fluidic connection to the fifteenth port of the quad connector;
wherein the nineteenth end of the tenth pipe forms a fluidic connection to the sixteenth port of the quad connector;
wherein the twentieth end of the tenth pipe forms a fluidic connection to the muffler.

* * * * *